United States Patent [19]

Harding

[11] 4,178,088

[45] Dec. 11, 1979

[54] PHOTOGRAPHIC PROCESSOR

[76] Inventor: Herbert D. Harding, 7900 Viscount St., El Paso, Tex. 79926

[21] Appl. No.: 921,332

[22] Filed: Jul. 3, 1978

[51] Int. Cl.[2] ..... G03D 3/02

[52] U.S. Cl. ..... 354/308; 354/324; 354/330

[58] Field of Search ..... 354/299, 307, 308, 309, 354/312, 313, 314, 323, 324, 328, 329, 330

[56] References Cited

U.S. PATENT DOCUMENTS

| | | | |
|---|---|---|---|
| 558,348 | 4/1896 | Brockway | 354/308 |
| 903,052 | 11/1908 | Brown | 354/307 |
| 2,286,229 | 6/1942 | Richards | 354/307 |
| 2,349,337 | 5/1944 | Caps et al. | 354/330 |
| 2,519,337 | 8/1950 | Alberts et al. | 354/330 |
| 2,909,979 | 10/1959 | Corrons | 354/299 |
| 3,208,335 | 9/1963 | Doherty | 354/308 |
| 3,280,716 | 10/1963 | Gall | 354/323 |
| 3,626,835 | 12/1971 | Buechner | 354/299 |
| 3,698,307 | 10/1972 | Reichardt | 354/330 |
| 3,703,860 | 11/1972 | Wilkinson | 354/330 |
| 3,856,395 | 12/1974 | Comstock | 354/299 |
| 3,938,171 | 2/1976 | Masygan | 354/299 |
| 4,035,818 | 7/1977 | King | 354/323 |

FOREIGN PATENT DOCUMENTS

| | | | |
|---|---|---|---|
| 184845 | 9/1905 | Fed. Rep. of Germany | 354/308 |
| 451211 | 3/1925 | Fed. Rep. of Germany | 354/308 |
| 333590 | 9/1903 | France | 354/308 |
| 84278 | 3/1920 | Switzerland | 354/308 |
| 5307 | of 1900 | United Kingdom | 354/308 |
| 924477 | 2/1962 | United Kingdom | 354/308 |

*Primary Examiner*—L. T. Hix
*Assistant Examiner*—Alan Mathews
*Attorney, Agent, or Firm*—Christie, Parker & Hale

[57] ABSTRACT

Apparatus for processing film and prints includes a box which holds processing equipment. A removable cover is mounted over the box to form a light-tight processing chamber. The chamber has at least one armhole equipped with a light-tight sleeve. An inner light-tight door can be moved to open the hole when an operator's arm extends through the hole, and moved to close the hole when the arm is removed so that when film or paper is being processed within the chamber, the operator's arm can be withdrawn from the hole without danger of fogging the film or paper.

9 Claims, 12 Drawing Figures

PHOTOGRAPHIC PROCESSOR

BACKGROUND

A number of motorized drum processors for photographic films and papers have been described in the prior art. Typically, such processors include a drum or cylindrical reel for holding film or paper, a curved trough for holding processing solutions, a light-tight housing, a motor to drive the drum, and means for introducing and withdrawing processing solutions. Once loaded, many units can be operated in normal room light, but they must be loaded in the dark. This requirement limits the usefulness of the units, especially to amateur or small-volume users who may not have ready access to a photographic darkroom. One prior art processor requires that the operator remain in attendance during the entire processing period, which, of course, is inconvenient. Representative prior art processors are described in U.S. Pat. Nos. 903,052; 3,698,307; 3,703,860; 3,856,395; and 3,938,171.

SUMMARY

The present invention provides a compact processor for photographic films and papers, which can be loaded in a lighted room and left unattended during the processing period. The processor includes a box for holding processing equipment, such as a printer/enlarger or a rotatable drum in a trough which holds processing liquid. In the latter case, a water jacket around the trough keeps the processing liquid at a constant temperature. The drum is adapted to hold photographic film or paper, and is mounted to rotate in the trough for repeatedly immersing the film or paper in the processing liquid. A removable cover is mounted on the box in light-sealing relationship so the cover and the box form a light-tight processing chamber within which the drum rotates. In the preferred embodiment, the cover has a pair of armholes equipped with light-tight sleeves through which a user's arms can be inserted for loading the drum with film or paper. The cover has a shelf or work area inwardly of the armholes, and an inner door that is light-tight when closed.

To load the processor, a spool, roll, or sheet of film or paper in a light-tight magazine, cassette, cartridge, can, envelope, or the like, is placed on the shelf or work area within the cover. The user reaches into the unit through the sleeves, opens the inner door, unspools the film, for example, and loads it onto the drum, emulsion side out. The user then closes the inner door, thereby sealing the film within the processing chamber. The user's arms can then be withdrawn from the sleeves without any danger of light entering the processing chamber through the sleeves.

In another embodiment of the invention, the cover also has a light-tight port which communicates with the processing chamber, and which is adapted for coupling with a light-tight housing containing a photographic printer or enlarger. When a sheet of printing paper is exposed under the enlarger, it can be passed through the port of the processor into the processing chamber. The user can then reach through the sleeves of the processor, open the inner door, and load the paper onto the drum. Thus, all the steps necessary for making a photographic print can be accomplished conveniently, without the need of a darkroom.

In yet another embodiment, the processor of this invention includes a removable base in the form of a tray for holding bottles of processing solutions. In use, the base is removed and placed adjacent the processor. Temperature-controlled water is introduced into the water jacket of the processor through an inlet and flows from an outlet into the tray containing the bottles of processing solutions. The water flows through the tray to an outlet, from which the water flows to a drain or to a temperature control means for recirculation through the water jacket and the tray.

In a further embodiment, the processor includes a rotatable motor-driven drying rack for film. The rack is mounted on the processor in place of the cover. Processed, wet film is wound directly from the processing drum onto the drying rack, and the rack is rotated while the film dries to provide fast, uniform drying without water spots.

DETAILED DESCRIPTION OF THE INVENTION

Figure 1:
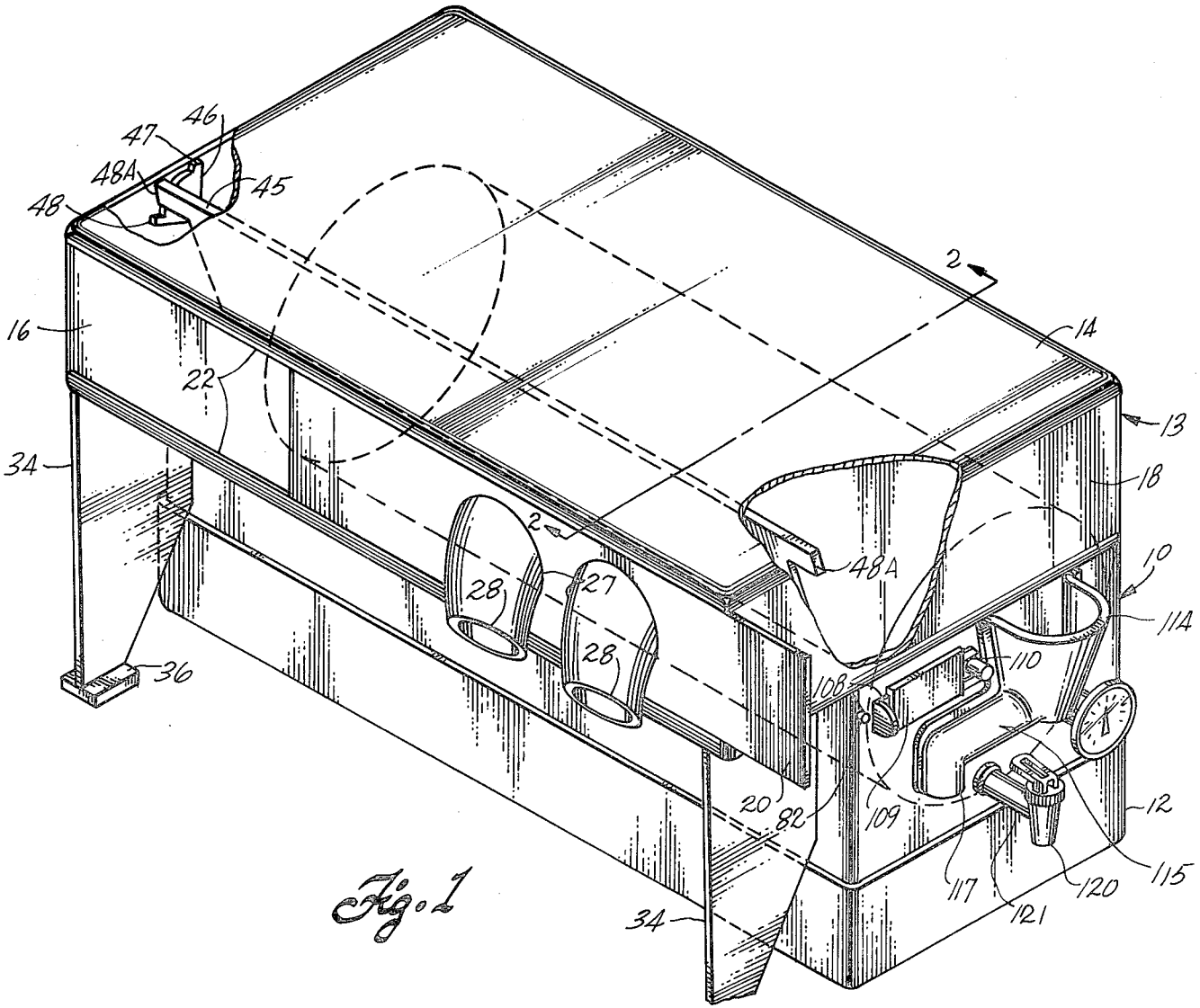
FIG. 1 is a front perspective view, partly broken away and partly in phantom, of the processor apparatus.
Figure 2:
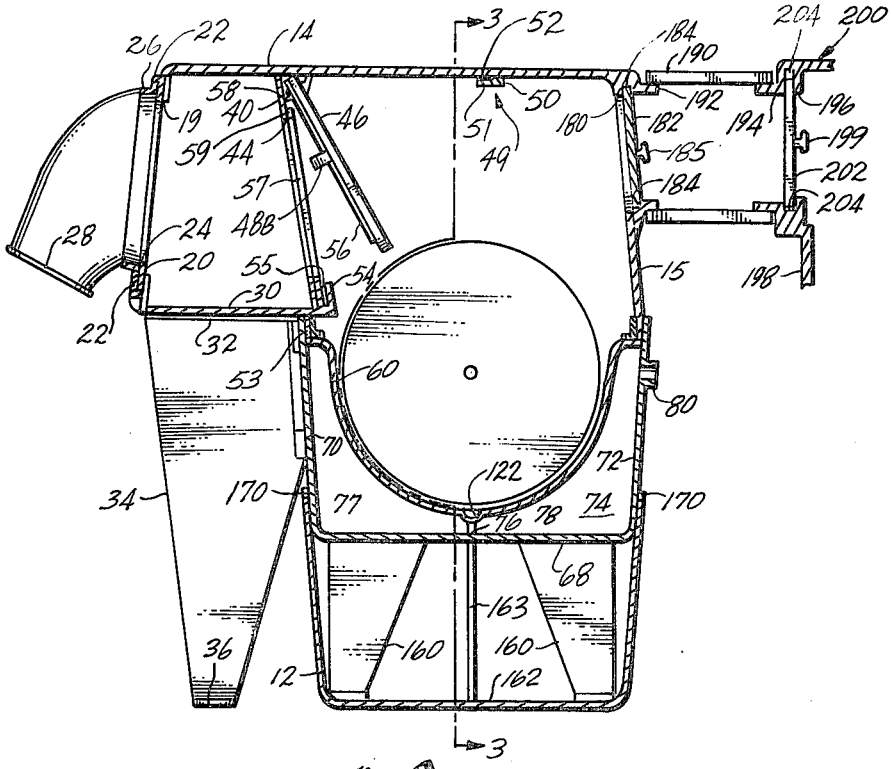
FIG. 2 is a view taken on line 2—2 of FIG. 1 showing the relationship of the armholes, inner door, and processing chamber of the unit joined to a light-tight enlarger or printer housing.
Figure 3:
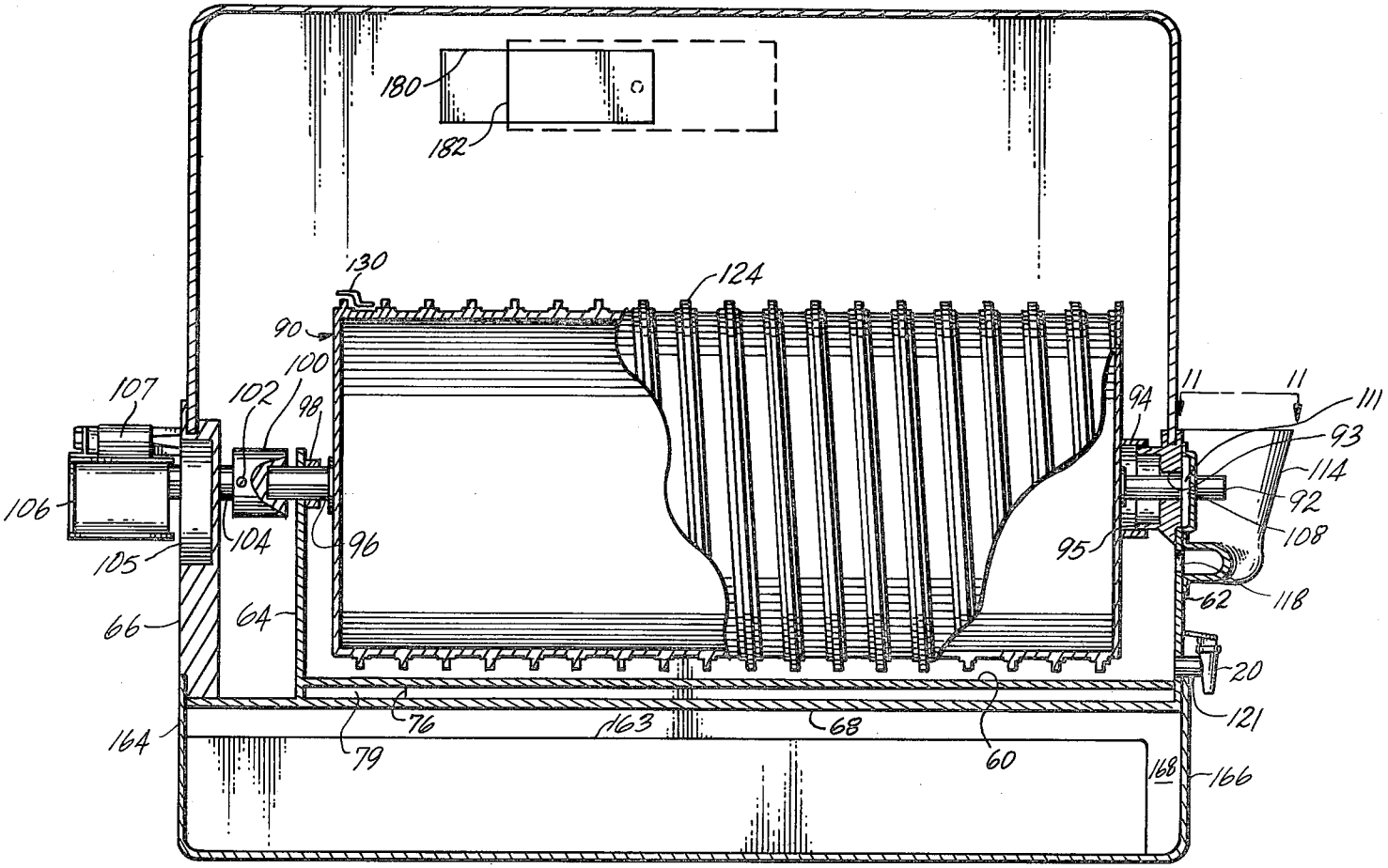
FIG. 3 is a view, partly broken away, taken on line 3—3 of FIG. 2.

Referring to FIGS. 1, 2, and 3, the processor includes a rectangular box 10, which rests in a removable rectangular tray 12. A removable cover 13 makes a light-tight fit on the top of the box so that the cover and box define a light-tight chamber. The cover includes a horizontal top 14, a downwardly and outwardly sloping back 15 and front 16, and vertical left and right (as viewed in FIG. 3) sides 17 and 18, respectively.

The front 16 of the box includes a rectangular opening 19 over which is mounted a slidable panel 20 having its upper and lower edges mounted to slide in horizontal tracks 22, which extend along the upper and lower edges of the front side. A pair of armholes 24 in the slidable panel are each surrounded by an outwardly-extending annular lip 26. A separate, light-tight, flexible sleeve 27 is sealed around each annular lip 26. The outer end of each sleeve includes an elastic cuff 28 adapted to make a snug fit around the arm (not shown) of an operator reaching through the sleeve and armhole into the cover as described below. The opening 19 extends over approximately the right three-fourths of the cover front, and the horizontal dimension of the panel 20 is about equal to that of the front so an operator can slide the panel from side to side to reach various parts of the chamber interior without uncovering the opening. Suitable stops (not shown) in the tracks 22 and on the panel 20 limit the travel of the panel to the right to the position shown in FIG. 1, and the travel of the panel to the left to where the ends of the panel are flush with the sides of the cover.

An inwardly-extending horizontal shelf 30, on the lower edge of the front of the cover, rests on a matching shelf 32 formed integrally with the upper edge of the box. A pair of downwardly-extending braces 34 are secured at their upper ends to the underside of shelf 32 and rest on feet 36 at a level coplanar with the bottom of the tray. An upright partition 40 makes a light-tight fit at its lower edge with the inner edge of shelf 30. The upper edge of the partition makes a light-tight fit against the top 14 of the cover.

An elongated, horizontal, rectangular opening 44 through the partition is adapted to be opened and closed by a horizontal inner rectangular door 45 mounted to swing about a horizontal axis on two hinge blocks 46 (FIGS. 1 and 2, only one block is shown) secured to the upper forward portion of the inside of the cover sides. Each hinge block is in the shape of a flat plate with an upwardly-extending stop 47 at the upper and rear portion of the plate, and a forwardly-extending stop 48 at the lower and front portion of the plate. The portion of the plate between the two stops is curved convex upwardly. A separate, outwardly-extending tab 48A at each end of the upper edge of the door extends into the space over the curved portion of each hinge block to support the door in either an open (horizontal) or a closed (upright) position. A pair of forwardly-extending door handles 48B (FIG. 2, only one handle is shown) on the front face of the door facilitates its operation. The door may be temporarily held in an open position by swinging it in a counterclockwise (as viewed in FIG. 2) direction, and sliding it forward so that the edge of the door farthest from the hinge block clears the forward edge of an L-shaped clip 49, having an upright leg 50 secured to the under surface of the cover top and a horizontal leg 51 spaced below the cover top and extending forwardly from leg 50 to leave a horizontal space 52 between the bottom surface of the cover top and the top surface of the horizontal leg. When the door is in a substantially horizontal position, it is slipped to the rear so that the rear edge of the door fits into the horizontal space 52, and the forward edge of the door is supported by the tabs 48A resting on the upper surface of the curved portion of the plate adjacent upwardly-extending stop 47 on the hinge block.

The door is closed by sliding it forward until its rear edge clears the clip 49. The door is pivoted in a clockwise (as viewed in FIG. 2) direction, and is held up by the handles so that the lower edge of the door clears the upper edge of a horizontal track 54 mounted on the inside edge of the shelf 30 of the cover. The track includes an upwardly-opening groove 55 which receives the lower edge of the door as the door is lowered so that the door tabs rest on the bottom of groove 55. The stops of the hinge blocks prevent the door tabs from becoming disengaged from the hinge blocks during the opening and closing of the door. A pair of vertical strips 56 at each end of the door fit against the outside surfaces of respective vertical strips 57 mounted on the partition 40 adjacent each end of the opening 44 through the partition. A horizontal strip 58 on the front face of the door rests on the upper surface of a horizontal strip 59 mounted across the inside of the partition 40 above the upper edge of the opening 44. Thus, when the door is in its closed position, the lower edge fits into the upwardly-opening groove 55 of track 54, and the strips 56 and 58 on the door make light-tight fits against respective adjacent strips 57 and 59 on the inside face of partition 40. When the cover is in place as shown in the drawings, and the inner door is closed, the cover and box make a light-tight chamber.

An upwardly-opening, U-shaped (as viewed in FIG. 2) trough 60 is disposed within the box in the right-hand (as viewed in FIG. 3) three-quarters of the box. The right end 62 of the box forms the right end of the trough. A separate upright wall 64, spaced inwardly from the left end 66 of the box, forms a left end of the trough. The trough is spaced from the bottom 68, the front 70, and the back 72 of the box to form a water jacket 74 around the outer portion of the curved part of the trough. A vertical baffle 76 is sealed along its lower edge against the top surface of the box bottom and at its upper edge with the bottom of the trough to divide the water jacket space into front and rear halves 77 and 78, respectively. The baffle extends from the right end of the trough to just short of the left end, so that water can flow through space 79 (FIG. 3) from one half of the water jacket to the other. Water is admitted into the jacket through an inlet 80 in the upper right-hand corner of the back side of the box. The water flows to the left end of the rear half of the water jacket, around the baffle 76, into the front half of the jacket, from left to right through the front half of the water jacket, and leaves the jacket through a discharge conduit 82 (FIG. 8) at the upper, forward corner of the right side of the box. A thermometer 84 mounted on the exterior of the box extends into the water jacket just below the inlet 80 to sense the temperature of the water entering it. This permits instant adjustment of the temperature of the incoming water, which is fairly critical for certain types of photographic processing steps. Ordinarily, the temperature is kept at about 68° F. for processing black and white film, and at about 100° F. for color film. However, the temperature can be adjusted to any value desired for a particular process.

A cylindrical drum 90 is mounted in the trough to rotate about a horizontal axis. The diameter of the drum is slightly less than that of the trough so the drum makes a close fit within the trough. A stub shaft 92 at the right (FIG. 39 end of the drum is journaled through an oversized hole 93 in the right end 62 of the box. An outwardly-extending sleeve 94 on the right end of the drum makes a close sliding fit around an inwardly-extending sleeve 95 on the right end of the box to form a light trap around the oversized opening 93.

A stub shaft 96 on the left end of the drum is journaled in an upwardly-opening slot 98 in the upper edge of wall 64. The outer end of stub shaft 96 is square in cross-section and fits into a mating opening of a coupling 100 secured by a set screw 102 to a drive shaft 104 journaled through a light-tight bearing 105 in the left end of the box. A speed reducer 106 is connected to the outer end of shaft 104 and is driven by an electric motor 107 mounted on the outside of the box to avoid adding unwanted heat to the chamber interior.

The drum is held in the operating position shown in FIG. 3 by a horizontal slide 108 mounted in a bracket 109 on the outside face of the right end of the box. The rear end of the slide includes a notch 110 which fits over an annular groove 111 in the stub shaft just exterior of the right end of the box. To change the drum (as referred to below), the slide 108 is pulled forward until its rear end clears the annular groove in the stub shaft 92.

The drum is then moved to the right until the stub shaft 96 at the left end of the drum clears the square socket in coupling 100. The drum is now raised at its left end and slipped out of the trough. A replacement drum of substantially identical construction is set in operating position by reversing the above procedure. In processing film, the drum is rotated at a speed of about 7 rpm.

Processing liquids are added to the trough through a filler cup 114 on the rear upper edge of the outer face of the right side of the box. A conduit 115 at the bottom of the filler cup includes a forwardly-extending horizontal section 116, and a downwardly-extending vertical section 117, the lower end of which opens through a hole 118 into the right end of the trough (FIG. 3). Thus, the conduit from the filler cup includes two 90° turns that prevent light from reaching the interior of the chamber through the fill spout.

A drain spigot 120 (FIG. 1) in the center of the lower edge of the right side 62 of the box connects through a conduit 121 with a longitudinally-extending drain groove 122 (FIG. 2) in the lowermost portion of the trough to permit complete drainage of processing liquids. The spigot is light-tight, even when opened, so that no light can enter the chamber through the spigot when solutions are drained from the trough.

A helical rib 124 extends around the exterior of the drum so that film or paper can be wound between adjacent turns of the rib.

Figure 4:
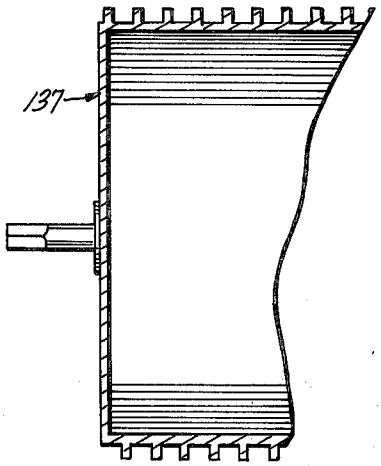
FIGS. 4–7 are fragmentary cross-sectional views of various drums adapted for different film sizes and for sheet film or paper.
Figure 5:
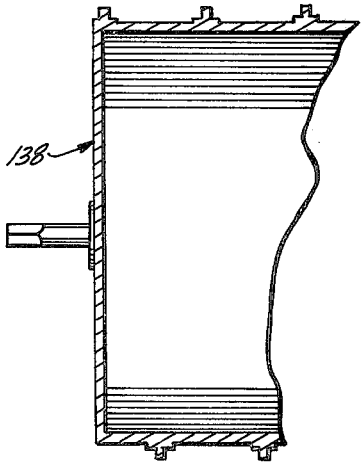

A clip 130, at the left (FIG. 3) end of the drum fits into the space between adjacent turns of the rib to hold film or paper (not shown) in place during processing. The drum shown in FIG. 4 is typical for processing 16 mm film. It can easily be removed and replaced by other drums for processing other types of film as described above.

Figure 6:
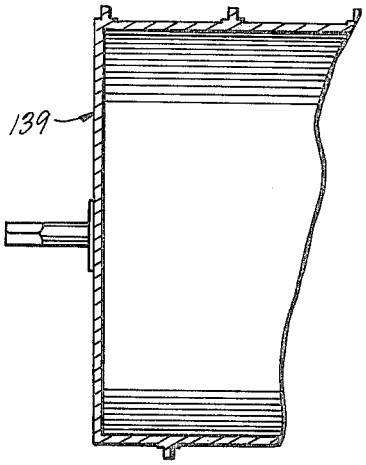
Figure 7:
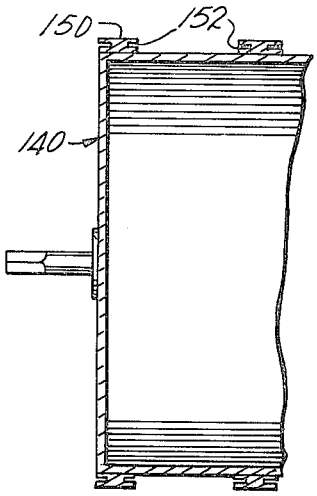

The drum shown in FIG. 3 can be replaced with any one of the drums shown in FIGS. 4, 5, 6, and 7. The drum 137, shown in FIG. 4, is designed for processing 8 mm film. The drum 138, shown in FIG. 5, will handle 35 mm film. The drum 139, shown in FIG. 6, is designed to handle 120 cm film. The drum 140, shown in FIG. 7, is especially designed to handle photographic paper, which must be held out of contact with the drum. Accordingly, the helical rib 150 around the drum exterior includes horizontally-opening grooves 152 to receive opposite edges of the paper (not shown) being treated. Thus, the film is held out of contact with the drum. This precaution is not necessary with film, because it is wound on the drums with the emulsion side facing outwardly.

Figure 8:
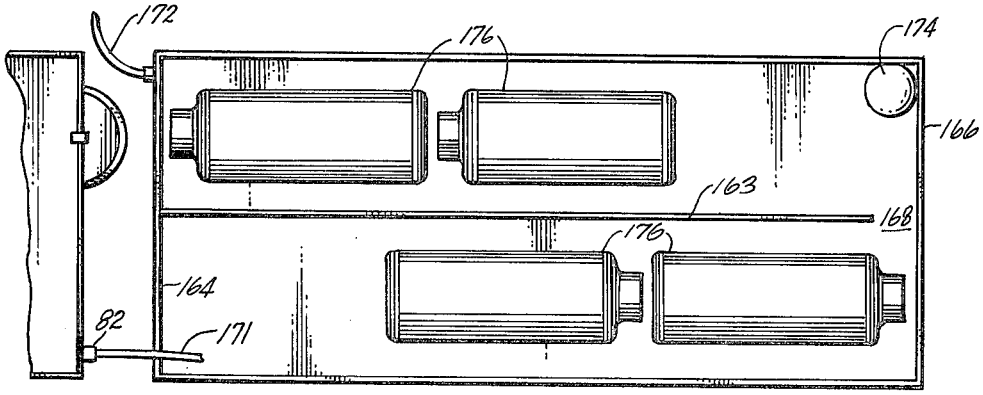
FIG. 8 shows the placement of the removable base for maintaining the temperature of the processing solutions.

As shown best in FIG. 2, legs 160, secured at their upper ends to the bottom of the box, extend down into and rest on the bottom 162 of the tray, which includes a longitudinally-extending, vertical partition 163 with its lower edge bonded to the centerline of the bottom of the tray. The partition 163 extends from the left side 164 of the tray to terminate just short of right side 166, thus leaving an opening 168 through which water may circulate. When the box is nested into the tray, as shown in FIG. 2, the upper edges of the tray rest on stops 170 on the exterior of the box. The tray is used for storing bottles of processing liquids. When it is desired to heat the contents of the bottle to the temperature of the water circulated through the water jacket, the box is removed from the tray, which is placed adjacent the right end of the box, as shown in FIG. 8. Water from outlet 82 flows through a hose 171 into the tray on the forward side of the partition, passes through opening 168, and leaves the tray through a discharge 172. A thermometer 174 in the tray monitors the temperature of the water passing around bottles 176.

Thus, the water passing through the water jacket surrounding the trough and around the bottles in the tray provides accurate temperature control without aggravating loss of volatile components, as would be the case if air were circulated through the trough to maintain the desired temperature. Moreover, the volume of the water jacket is at least three (preferably more than six) times that of the space between the drum and the trough so the mass and heat capacity of the water is equal to or greater than that of the relatively small amount of processing liquid in the trough, thus assuring quick adjustment of the processing liquid to the required temperature and maintainance of that temperature.

Referring to FIGS. 2 and 3, the back of the cover includes a rectangular, horizontal opening 180. A sliding door 182, mounted to travel in slots 184 on the outside of the back of the cover, can be moved with a handle 185 to open and close the opening 180. When the door is moved to the closed position, the opening is closed in a light-tight fashion so that no light can enter the chamber through opening 180. A light-tight sleeve 190 has one end sealed around an outwardly-extending flange 192 formed integrally with the cover around opening 180. The other end of the sleeve fits around a similar flange 194 mounted around an opening 196 in one wall 198 of a housing 200. A sliding door 202 is mounted in grooves 204 in the wall 198, so that the opening 196 can be opened and closed with a handle 199, as just described for opening 180. The housing 200 can be a light-tight housing for a printer, an enlarger, or the like. This permits photographic material to be transferred from the printer or enlarger into the chamber of the processor without exposing the material to light. The housing also may have a sliding panel over an access opening, an inner door, armholes, and sleeves identical with those shown in FIGS. 1–3, so all the steps necessary for making a photographic print can be accomplished conveniently without the need of a darkroom.

In using the processor of this invention, the trough is filled with the proper processing liquid, say, developer solution. Water is circulated through the water jacket surrounding the trough until the processing liquid is at the required temperature. If desired, the tray is mounted as shown in FIG. 8, and water is circulated through it to bring the additional processing liquids to the desired temperature. The water may be supplied from a conventional source, adjusted to the desired temperature, and can be discharged through a drain. Alternatively, the water can be continuously circulated by a pump (not shown) and kept at the desired temperature by suitable heating or refrigeration controlled by well-known thermostatic means (not shown).

One or more spools, rolls, or sheets of film or paper in a light-tight magazine, cassette, cartridge, can, envelope, or the like is placed on the shelf, and the cover is secured, as shown in FIG. 2, to provide a light-tight chamber. The operator extends his arms through the sleeves and into the armholes. The elastic cuffs on the sleeves make the light-tight fit around the operator's arms. The operator then selects one of the magazines, envelopes, or the like and opens it. He then opens the inner door and secures it in the open position. The operator then attaches the photographic material to the drum. If film is being processed, the emulsion side is disposed outwardly. One end of the film is secured to the clip on the drum, which is then rotated slowly while the film is laid down between adjacent turns of the outwardly-extending rib. The tail end of the film is then secured to the drum by a clip or adhesive tape (not shown). If photographic paper is being processed, the operator fits the edges of the paper into the horizontal grooves 152, shown in FIG. 7. After the photographic material is properly loaded on the drum, the inner door is closed, and the operator is free to withdraw his arms from the armholes. The electric motor is turned on, and the photographic material on the rotating drum is passed repeatedly through the processing liquid for the required time.

If additional work is to be processed without changing the processing liquid, the finished work can be removed from the drum and new work loaded on as just described, all without exposing the work in process to light. After the first stage of work is finished, say, development is completed, the trough is drained and refilled with the next processing liquid to be used, ordinarily rinse water. The photographic material can then be serially processed until the development is completed, and the film or paper has been rinsed with water, and is ready for drying.

Figure 9:
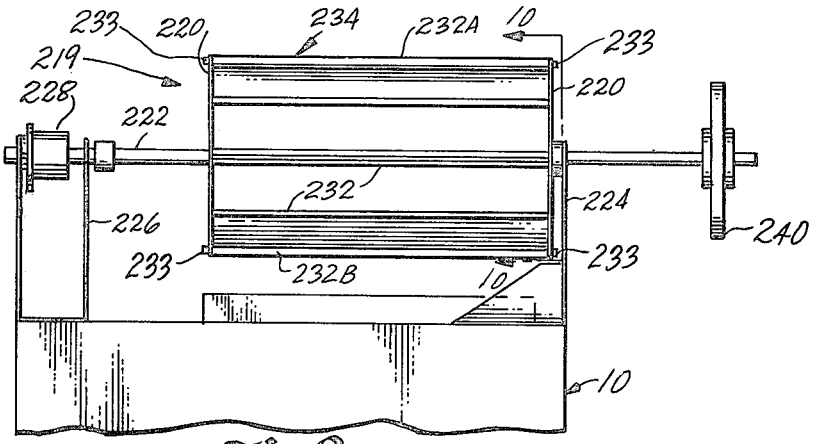
FIG. 9 is a front elevational view of the motorized drying rack mounted atop the processor.
Figure 10:
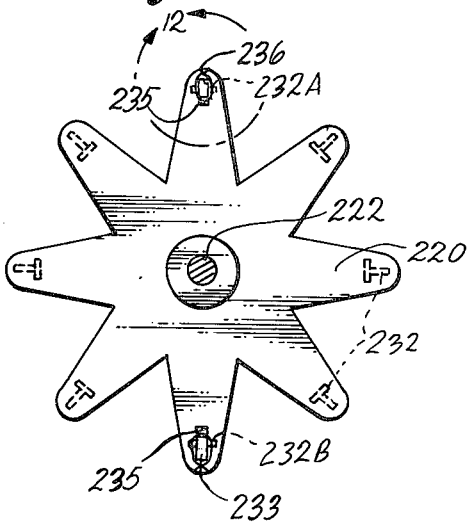
FIG. 10 is a view taken on line 10—10 of FIG. 9.
Figure 11:
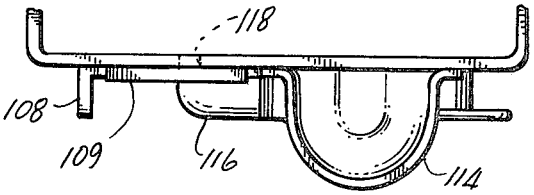
FIG. 11 is a view taken on line 11—11 of FIG. 3.
Figure 12:
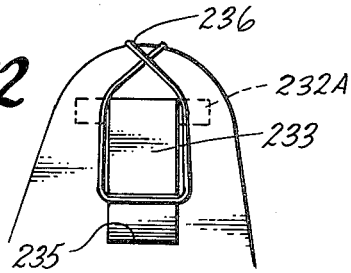
FIG. 12 is an enlarged view of area within lines 12—12 of FIG. 10.

At this point, the trough is drained completely, and the cover is removed. A drying rack 219, shown in FIG. 9, is then mounted in the grooves in the upper edge of the box to facilitate drying of the processed material. The dryer includes a pair of 8-pointed, star-shaped end plates 220 (see FIG. 10) mounted at longitudinally-spaced locations on a shaft 222 journaled through supports 224 and 226. An electric motor 228 supplies power through direct drive to the shaft 222. Horizontal T-beams 232 are secured at their ends to the interior of end plates 220 to form an open cage 234. Two of the T-beams 232A and 232B on opposite sides of the star-shaped plates have flat projections 233 which extend through respective radial enclosed slots 235 in the outer ends of the respective points of the plates. A separate rubber band 236 (FIG. 10, only one band is shown) is wrapped around the ends of T-beams 232A and 232B and over the respective adjacent portions of the star-shaped plates to urge the T-beams outwardly against the outer ends of the slots 235.

Film from the drum is secured to one end of one of the T-beams 232, say, with adhesive tape, and then wound helically around the cage. A wheel 240 on the right (as viewed in FIG. 9) end of shaft 222 facilitates turning the rack by hand while film is transferred from the drum to the drying rack. The drum is disengaged from the coupling 100 during the transfer by moving slide 108 to clear the annular groove 111 in the right end of the drum shaft 92, and then shifting the drum to the right. The tail end of the film is also secured to one of the T-beams 232. The motor 228 is turned on, and the cage is rotated until the film is uniformly dried without water spots. If the film shrinks as it dries, the rubber bands on the movable T-beams 232A and 232B stretch to let the beams move inwardly and thus avoid film damage.

From the foregoing description, it will be clear that this invention provides a complete, portable darkroom facility for all phases of processing photographic material.

I claim:

1. Apparatus for processing photographic film comprising a box open at the top for holding processing equipment, the box having front and back walls, a removable cover mounted on the open top, the cover having front and rear walls spaced substantially farther apart than the front and back walls of the box, the cover including a wide shelf portion extending horizontally from an inner margin at the front wall of the box to the front wall of the cover to close off the gap resulting from the wider spacing of the front and rear walls of the cover relative to the front and back walls of the box, the cover having an inner light-tight partition extending between the inner margin of the shelf and the top of the cover to form an outer compartment, with the shelf forming the bottom wall of the outer compartment, a door in the partition hinged at the top to permit the door to swing open inwardly and up against the top of the cover and to drop under the action of gravity to a closed position, the front of the cover having a pair of openings for access to the outer compartment, a pair of short flexible sleeves secured to the cover around the respective access openings, each sleeve forming a cuff adapted to fit the wrist of a user when the hands are inserted through the sleeves and into the outer compartment, the outer compartment and shelf forming a light-tight work area when the user's hands are inserted through the sleeves, in which light-sensitive film can be unloaded from its container, the partition and the door when closed forming a light-tight barrier between the outer compartment and the interior of the box so as to allow the hands to be safely removed from the sleeves after the film is transferred through the door to the processing equipment in the box.

2. Apparatus of claim 1 wherein said partition and door, when closed, are tilted at an acute angle to the shelf, whereby the hinged door is held closed against the partition by gravity.

3. Apparatus according to claim 1 which includes means for holding the door in an open position.

4. Apparatus according to claim 1 which includes a trough disposed in the box for holding a processing liquid for photographic materials and a drum mounted to rotate in the trough.

5. Apparatus according to claim 4 which includes a water jacket disposed around the trough exterior, and means for circulating water in and out of the water jacket.

6. Apparatus according to claim 1 which includes a tray positioned below the box, the bottom of the box nesting inside the top of the tray.

7. Apparatus according to claim 6 which includes means for holding containers of chemicals in the tray, and means for circulating water from the water jacket through the tray around the containers to pre-warm the chemicals in the containers to the temperature of the processing liquid in the trough.

8. Apparatus according to claim 1 which includes a trough disposed in the box, a rotatable drying rack mounted over the trough, means for securing photographic material to the rack, and means for rotating the rack while photographic material is secured to it to cause the material to dry uniformly and without water spots.

9. Apparatus according to claim 4 which includes a groove in the bottom of the trough for collecting liquid, a valved drain conduit extending from the groove through the box, and a tortuous filler conduit extending from the chamber exterior into the trough.

* * * * *